US006467636B1

(12) United States Patent
Schaefer

(10) Patent No.: US 6,467,636 B1
(45) Date of Patent: Oct. 22, 2002

(54) CORNER SHELF WITH THREE POINT INSTALLATION

(75) Inventor: Markus V. Schaefer, Washington Crossing, PA (US)

(73) Assignee: PGM, LLC, Barrington, NJ (US)

( * ) Notice: Subject to any disclaimer, the term of this patent is extended or adjusted under 35 U.S.C. 154(b) by 0 days.

(21) Appl. No.: 09/703,849

(22) Filed: Nov. 1, 2000

(51) Int. Cl.[7] ..... A47F 5/08
(52) U.S. Cl. ..... 211/90.01; 108/147.11
(58) Field of Search ..... 211/90.01, 90.02; 108/142.11, 157.1, 157.13

(56) References Cited

U.S. PATENT DOCUMENTS

| | | | | |
|---|---|---|---|---|
| 483,069 | A | 9/1892 | Legg | |
| 1,286,588 | A | 12/1918 | Goodykoontz | |
| 1,654,409 | A | 12/1927 | Browne | |
| 2,036,184 | A | 4/1936 | Armstrong | |
| 2,219,975 | A | 10/1940 | Bentz | |
| 2,318,921 | A | 5/1943 | Bullard | |
| 2,389,349 | A | * 11/1945 | Eastman | 211/90.01 X |
| 3,033,376 | A | 5/1962 | Eastman | |
| 3,906,872 | A | 9/1975 | Erickson | |
| 4,536,995 | A | 8/1985 | Frederick | |
| 4,664,266 | A | 5/1987 | Fausett et al. | |
| 4,708,310 | A | * 11/1987 | Smith | 211/90.01 X |
| 4,886,236 | A | 12/1989 | Randall | |
| 5,992,654 | A | 11/1999 | Dente, Jr. | |
| 6,196,139 | B1 | * 3/2001 | Jensen et al. | 108/42 |

* cited by examiner

*Primary Examiner*—Daniel P. Stodola
*Assistant Examiner*—Erica B Harris
(74) *Attorney, Agent, or Firm*—Amster, Rothstein & Ebenstein

(57) ABSTRACT

A corner shelf is easily mountable on and removable from a pair of walls defining a corner and a corner apex joining the walls. The corner shelf has two mutually transverse sides and a shelf apex joining the sides. The shelf is configured and dimensioned exclusively for three point installation in a corner, and is characterized by (A) only a pair of laterally spaced openings disposed on one shelf side, and (B) only a single opening on the other shelf side. Each of the openings is substantially spaced from the shelf apex, and the openings are adapted to mount the shelf in the corner. Preferably a total of only three support members project inwardly from the corner walls, and each of the openings is configured and dimensioned to at least partially receive therein a portion of a respective support member.

9 Claims, 1 Drawing Sheet

FIG. 1
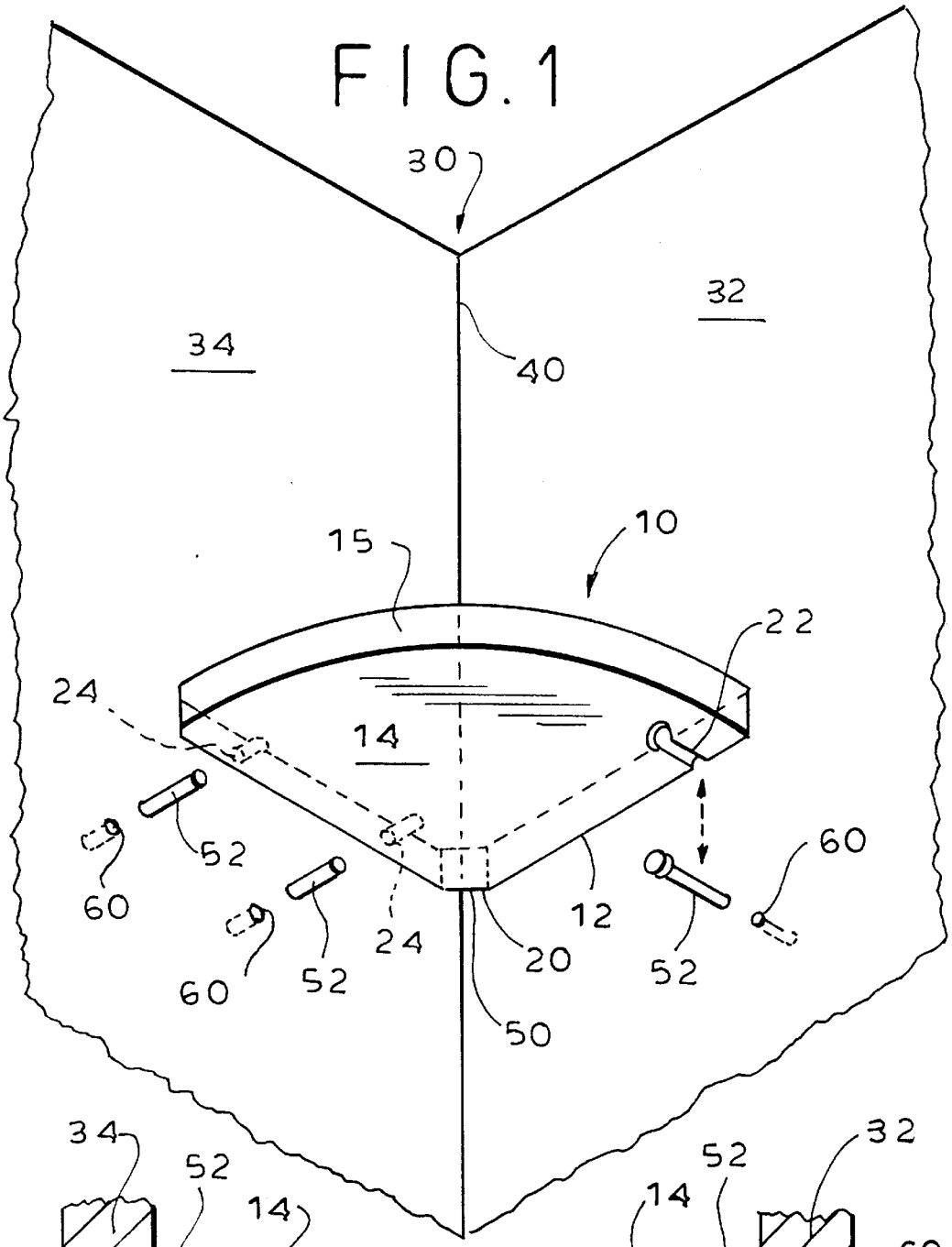
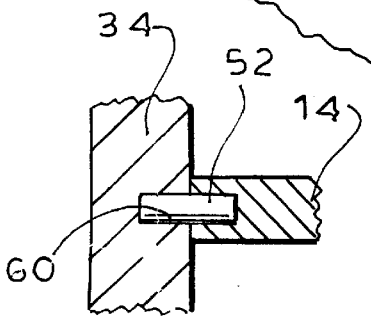
FIG. 2
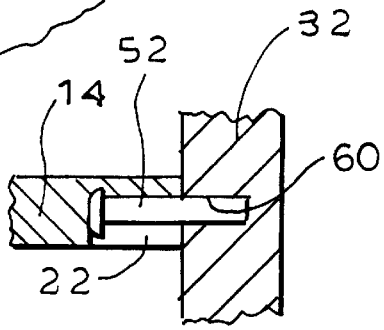
FIG. 3

CORNER SHELF WITH THREE POINT INSTALLATION

BACKGROUND OF THE INVENTION

The present invention relates to a corner shelf, and more particularly to a corner shelf which is easily mountable on and removable from a wall corner using a three point installation technique.

Conventional corner shelves, adapted to be supported by walls forming a corner, are typically designed to utilize "a four point installation" technique. In this technique, there are two laterally spaced openings disposed on each side of the shelf. A total of four support members project inwardly from the corner walls, two support members for each corner wall. Each of the openings is configured and dimensioned to at least partially receive therein a portion of a respective one of the four support members. As used herein, the reference to "four point installation" includes six, eight or more point installations, as may be preferred for a large or heavy corner shelf requiring additional support. Inasmuch as only three points are required to define a plane—here, the plane supporting the corner shelf—clearly at least one of the shelf openings and at least one of the support members of the four point installation is superfluous. In other words, three of the support members are operational, and the fourth is either not used (if not in the proper plane) or simply redundant (if in the proper plane). Worse yet, if not in the proper plane the fourth support member typically allows limited tilting or wobbling of the corner shelf depending on where weight is placed on its upper surface.

Conventional corner shelves are also typically designed to utilize a "three point installation" technique. In this technique, there is a single opening on each side of the shelf (or more openings on each side in the case of a large or heavy shelf) and a third opening extending through the shelf apex. A total of three support members projecting inwardly from the corner, one from each corner wall and one from the corner apex, thereby to form a corner apex/shelf apex joint. While the three point installation technique has, as an advantage over the four point installation technique, that it does not require the use of an unnecessary or redundant fourth opening and fourth support member, it has not proven to be entirely satisfactory in use.

A wall corner is defined by the intersection of two walls and may not provide enough structure to support the support member passing thereinto or therethrough. In any case, placement of the support member in the corner apex tends to be quite difficult, especially if it involves drilling through the corner apex, and almost impossible if the walls are formed of masonry. Further, the shelf apex (where the two mutually transverse legs or sides come together) is often difficult to prepare for receipt of a support member, especially where it is necessary to drill through the shelf apex.

Another disadvantage of the conventional three point installation technique is that the presence of the support member bridging the corner apex and the shelf apex interferes with and typically totally precludes the passage of wires between the corner shelf and the wall corner—e.g., so that electricity can be provided via wires extending from below the shelf to objects supported by the shelf.

A further disadvantage of the conventional three point installation technique is that, in order for the shelf to be easily mountable on or removable from a pair of walls defining the corner, typically some bracket or cleat portion of each of the support members remains visible after installation, thus distracting from the esthetics of the mounting.

Thus neither the conventional three point installation technique using a shelf apex/corner apex support member nor the conventional four point installation technique is entirely satisfactory.

Accordingly, it is an object of the present invention to provide a corner shelf which is easily mountable on or removable from a pair of walls defining a corner, using a novel three point installation technique not involving any shelf apex/corner apex joint.

Another object is to provide such a shelf wherein the support members joining the corner shelf to the corner walls are not each visible, and where preferably at least two of the three support members are not visible at all.

It is also an object of the present invention to provide a corner shelf which may be mounted to corner walls by a novel three point installation technique providing a passageway between the shelf apex and the corner apex for at least one wire (such as an electrical wire).

SUMMARY OF THE INVENTION

It has now been found that the above and related objects of the present invention are obtained in a corner shelf easily mountable on and removable from a pair of walls defining a corner and a corner apex joining the walls. The corner shelf has two mutually transverse sides and a shelf apex joining the sides, the shelf being configured and dimensioned exclusively for three point installation in a corner. The shelf is characterized by (A) only a pair of laterally spaced openings disposed on one side of the shelf, and (B) only a single opening on the other side of the shelf. Each of the openings is substantially spaced from the shelf apex, and the openings are adapted to collectively mount the shelf in the corner.

Preferably a total of only three support members project inwardly from the corner walls, and each of the openings is configured and dimensioned to at least partially receive therein a portion of a respective one of the three support members.

In a preferred embodiment, the pair of openings on one side of the shelf are side-opening apertures configured and dimensioned to extend 360° about a cross section of the portion of the respective support members received therein, and the single opening on the other side of the shelf is a bottom-opening recess configured and dimensioned to extend not more than about 180° about a cross section of the portion of its respective support member received therein. The pair of openings facilitates initial easy mounting thereof on their respective support member portions, and the single opening facilitates subsequent easy mounting thereof on its respective support member portion. Further, the single opening facilitates initial easy removal thereof from its respective support member portion, and the pair of openings facilitates subsequent easy removal thereof from their respective support member portions.

Preferably the apertures totally conceal their respective support member portions therein, and the recess conceals at least a top aspect of its respective support member portion therein.

When the shelf is mounted to the corner walls, the shelf apex is preferably spaced from the corner apex to define a vertically extending passageway therebetween for the passage of at least one wire. For example, the shelf apex may be chamfered to define the passageway.

The present invention also encompasses in combination the corner shelf, a pair of walls defining a corner and a corner apex joining the walls, and a total of only three support members projecting inwardly from the corner walls. One corner wall is characterized by a pair of laterally spaced inwardly projecting support members, and the other corner wall is characterized by a single inwardly projecting support member. Each of the three support members is substantially spaced from the corner apex, and the three support members are adapted to collectively mount the shelf in the corner.

BRIEF DESCRIPTION OF THE DRAWING

The above and related objects, features and advantages of the present invention will be more fully understood by reference to the following detailed description of the presently preferred, albeit illustrative, embodiments of the present invention when taken in conjunction with the accompanying drawing wherein:

FIG. 1 is a fragmentary isometric view from the bottom of a corner shelf according to the present invention, supported in a wall corner; and FIGS 2 and 3 are fragmentary sectional views in elevation of the wall corner and, respectively, a shelf aperture and a shelf recess, as secured together by pins.

DETAILED DESCRIPTION OF THE PREFERRED EMBODIMENTS

Referring now to the drawing, and in particular to FIG. 1 thereof, therein illustrated is a corner shelf according to the present invention, generally designated by the reference numeral 10. As illustrated, the corner shelf 10 resembles a right angle triangle with the hypotenuse being curved so that its overall configuration resembles a pie wedge. Clearly the corner shelf 10 may be of a different configuration—for example, it may be generally triangular in shape (with the hypotenuse being linear rather than arcuate).

The corner shelf 10 defines two mutually transverse legs or sides 12, 14, a shelf apex 20 joining the sides 12, 14, and a hypotenuse or curve 15 joining the free ends of sides 12, 14 as illustrated. The shelf is characterized by only a single opening 22 on one side of the shelf (as illustrated, side 12) and only a pair of laterally spaced openings 24 on the other side of the shelf (as illustrated, side 14). Each of the three openings 22, 24 is substantially spaced from the shelf apex 20 and adapted to cooperatively (collectively) mount a shelf 10 in a wall corner. As a general rule, opening 22 and one of the openings 24 will be closely adjacent the hypotenuse or curve 15 of the corner shelf 10, preferably within 96 mm, while the other opening 24 is relatively close to (but still substantially spaced from) the shelf apex 20, preferably within 32 mm.

The corner shelf 10 is configured and dimensioned exclusively for a novel three point installation in a corner, generally designated 30, formed by a pair of walls 32, 34 defining a corner apex 40 where the walls 32, 34 join or intersect. The angle formed by the legs 12, 14 of shelf 10 will correspond generally to the angle formed by walls 32, 34 of the corner 30. Thus, where the walls 32, 34 of corner 30 define an acute or obtuse angle, the legs or sides 12, 14 of shelf 10 will define a corresponding acute or obtuse angle.

When the shelf 10 is mounted to the corner walls 32, 34, the shelf apex 20 is preferably spaced from the corner apex 40 to define a vertically extending passageway 50 therebetween for passage of at least one wire. To produce the desired spacing, the shell apex 20 is preferably beveled, chamfered, or cut away to define the passageway 50.

The shelf 10 is mounted in the corner 30 using a total of only three support members 52 which project inwardly from the corner walls 32, 34. The support members 52 may be ordinary screws, screws having an unthreaded stem portion between a threaded tip and the head, ordinary screws having a sleeve extending from the head toward the threaded end, nails or the like. Where appropriate holes—e.g., pre-drilled openings 60—are already provided within the walls 32, 34, the support member 52 may be a simple unthreaded pin having one end entering a wall 32, 34 and the other end entering a shelf opening 22, 24.

Each of the shelf openings 22, 24 is configured and dimensioned to partially receive therein at least a portion (e.g., the unthreaded stem portion, the sleeve, or the like) of a respective one of the three support members 52. As illustrated in FIG. 3, the single opening 22 on shelf side 12 is preferably a bottom-opening groove or recess configured and dimensioned to extend not more than 180° about a cross section of the portion of the respective support member 52 received therein. As illustrated in FIG. 2, the pair of openings 24 on shelf side 14 are preferably side-opening apertures configured and dimensioned to extend 360° about a cross section of the portion of the respective support members 52 received therein. The use of at least one (and preferably two) side-opening aperture(s) 24 instead of only bottom-opening recesses 22 contributes greatly to the stability of the mounted shelf 10 by reducing wobbling or tilting of the mounted shelf in a way that bottom-opening recesses cannot.

Preferably the support member 52 in wall 32 and its groove or recess 22 have enlarged mating section (illustrated in FIG. 3 as heads) to stabilize the position of the shelf 10 relative to wall 32 by limiting withdrawal of the shelf from the support member 52 in wall 32.

The apertures 24 totally conceal the portions of their respective support members 52 disposed therein, and the recess 22 conceals at least a top aspect of the portion of its respective support member 52 disposed therein. When the recess 22 is of sufficient depth to allow total entry of the support member portion thereinto, the received portions of each of the support members 52 are essentially concealed within the shelf 10 and corner walls 32, 34.

The shelf 10 is easily mountable on and easily removable from the walls 32, 34 defining corner 30. The pair of apertures 24 facilitate initial easy mounting thereof on their respective support member portions projecting from wall 34, and the single recess 22 facilitates subsequent easy mounting thereof on its respective support member portion projecting from wall 32. In other words, the shelf apertures 24 on side 14 receive their respective support member portions while shelf 10 is tilted so that the shelf side 12 is maintained above its support member portion projecting from wall 32, and then shelf side 12 is dropped downwardly (either by gravity or forcefully) so that single recess 22 at least partially receives its respective support member portion projecting inwardly from wall 32.

Further, the single groove or recess 22 facilitates initial easy removal thereof from its respective support member portions projecting from wall 32, and the pair of apertures 24 facilitate subsequent easy removal thereof from their respective support member portions. In other words, shelf side 12 is easily lifted to disengage its single recess 22 from its respective support member portion, thereby enabling tilting of the shelf and subsequent removal of the apertures 24 from their respective support member portions.

To enable the easy mounting and removal of the corner shelf 10 in and from the corner 30, the apertures 24 are preferably oversized relative to their respective support member portions, preferably by about 1 mm in diameter, thereby to facilitate tilting of the shelf 10 within the corner 30 about the axis of intersection between shelf side 14 and corner wall 34.

The pair of apertures 24 are preferably straight but oversized holes positioned and dimensioned to limit the shelf from unrestrained rocking up or down on support members 52 (while still enabling the shelf tilting necessary for shelf mounting and removal) and from slipping in or out. Preferably, as illustrated in FIG. 3, the single recess 22 is in the form of a keyhole or lock slot and the portion of support member 52 received therein is in the form of a key which, when received in the keyhole, appropriately positions the shelf 10.

While the present invention has been described in terms of a shelf 10, support members 52, and a wall corner 30, it will be appreciated by those skilled in the craft arts that the support members 52 do not necessarily have to be pre-installed into the wall corner 30 for subsequent receipt by the recess 22 and apertures 24 of the shelf 10. For example, the support members may be straight pins which are mounted in the shelf 10 for sliding movement along their respective longitudinal axes. Such pins are slidable from an initial position longitudinally bounded by the shelf sides 12, 14 to a final position longitudinally extending outwardly from the shelf sides 12, 14 and into pre-formed openings 60 in the corner walls 32, 34. However such a construction results in a more complex shelf and still requires three openings 60 to be drilled into the corner walls 32, 34. Typically the pair of apertures 24 will remain simply apertures adapted to receive pins extending from the respective support member portions projecting from wall 34, but the single recess 22 may include a slidable support member (not shown) movable between a retracted position not extending laterally beyond the shelf side 12 and an extended position wherein a portion thereof is received in the pre-formed opening 60 of corner wall 32.

To summarize, the present invention provides a corner shelf which is easily mountable on or removable from a pair of walls defining a corner, using a novel three point installation technique not involving any shelf apex/corner apex joint. The support members joining the corner shelf to the corner walls are not each visible (and indeed preferably at least two of the three support members are not visible at all and optionally all three are substantially concealed). The corner shelf is mounted to the corner walls so as to provide a passage way therebetween for at least one wire (such as an electric wire) thereby to provide electrical communication from below the shelf to above the shelf.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

I claim:

1. A corner shelf easily mountable on and removable from a total of only three support members projecting inwardly from a pair of walls defining a corner and a corner apex joining the walls, comprising:

a corner shelf with two mutually transverse sides, a front, and a shelf apex end joining said sides, said shelf being configured and dimensioned exclusively for three point installation in a corner, said shelf being characterized by (A) only a pair of laterally spaced openings disposed on one side of said shelf, and (B) only a single opening on the other side of said shelf disposed substantially adjacent said front;

each of said openings being substantially spaced from said shelf apex end, and said openings being adapted to collectively mount said shelf in the corner;

each of said openings being configured and dimensioned to at least partially receive therein during mounting a portion of a respective one of the three support members.

2. A corner shelf easily mountable on and removable from a pair of walls defining a corner and a corner apex joining the walls, comprising:

a corner shelf with two mutually transverse sides and a shelf apex end joining said sides, said shelf being configured and dimensioned exclusively for three point installation in a corner, said shelf being characterized by (A) only a pair of laterally spaced openings disposed on one side of said shelf, and (B) only a single opening on the other side of said shelf;

each of said openings being substantially spaced from said shelf apex end and being configured and dimensioned to at least partially receive therein a portion of a respective one of three support members projecting inwardly from the corner walls, and said openings being adapted to collectively mount said shelf in the corner;

said pair of openings on one side of said shelf being side-opening apertures configured and dimensioned to extend 360° about a cross section of the portion of the respective support members received therein, and said single opening on the other side of said shelf being a bottom-opening recess configured and dimensioned to extend not more than about 180° about a cross section of the portion of its respective support member received therein.

3. The corner shelf of claim 2 wherein said pair of openings facilitates initial mounting of said pair of openings on their respective support member portions, and said single opening facilitates subsequent mounting of said single opening on its respective support member portion.

4. The corner shelf of claim 2 wherein said single opening facilitates initial removal of said single opening from its respective support member portion, and said pair of openings facilitates subsequent removal of said pair of openings from their respective support member portions.

5. The corner shelf of claim 2 wherein said apertures totally conceal their respective support member portions therein, and said recess conceals at least a top aspect of its respective support member portion therein.

6. The corner shelf of claim 2 wherein, when said shelf is mounted to the corner walls, said shelf apex end is spaced from the corner apex to define a vertically extending passageway therebetween for the passage of at least one wire.

7. The corner shelf of claim 6 wherein said shelf apex end is chamfered to define said passageway.

8. In combination, a corner shelf, a pair of walls defining a corner and a corner apex joining the walls, and a total of only three support members projecting inwardly from said corner walls;

one said corner wall being characterized by a pair of laterally spaced inwardly projecting support members and the other said corner wall being characterized by a single inwardly projecting support member;

each of said three support members being substantially spaced from said corner apex, and said three support members being adapted to mount said shelf in said corner;

said corner shelf being mountable on and removable from said three support members and comprising a corner shelf with two mutually transverse sides, a front, and a shelf apex end joining said sides, said shelf being configured and dimensioned exclusively for three point installation in a corner, said shelf being characterized by (A) only a pair of laterally spaced openings disposed on one side of said shelf, and (B) only a single opening on the other side of said shelf disposed substantially adjacent said front;

each of said openings being substantially spaced from said shelf apex end, and said openings being adapted to collectively mount said shelf in said corner;

each of said openings being configured and dimensioned to at least partially receive therein during mounting a portion of a respective one of said three support members.

9. In combination, a corner shelf, a pair of walls defining a corner and a corner apex joining the walls, and a total of only three support members projecting inwardly from said corner walls;

(A) one said corner wall being characterized by a pair of laterally spaced inwardly projecting support members, and the other said corner wall being characterized by a single inwardly projecting support member;

(B) each of said three support members being substantially spaced from said corner apex, said three support members being adapted to mount said shelf in said corner; and (C) said corner shelf having two mutually transverse sides and a shelf apex end joining said sides, said shelf being configured and dimensioned exclusively for three point installation in said corner, said shelf being characterized by only a pair of laterally spaced openings disposed on one side of said shelf, and only a single opening on the other side of said shelf;

each of said openings being substantially spaced from said shelf apex and configured and dimensioned to at least partially receive therein a portion of a respective one of said three support members, said openings being adapted to mount said shelf in said corner;

said pair of openings on one side of said shelf being side-opening apertures configured and dimensioned to extend 360° about a cross section of the portion of the respective support members received therein, and said single opening on the other side of said shelf being a bottom-opening recess configured and dimensioned to extend not more than 180° about a cross section of the portion of its respective support member received therein;

said pair of apertures facilitating initial mounting of said pair of apertures on their respective support member portions, and said single recess facilitating subsequent mounting of said recess on its respective support member portion;

said single recess facilitating initial removal of said recess from its respective support member, and said pair of apertures facilitating subsequent removal of said pair of apertures from their respective support members;

said apertures totally concealing their respective support member portions therein, and said recess concealing at least a top aspect of its respective support member portion therein;

when said shelf is mounted to said corner walls, said shelf apex end being spaced from said corner apex to define a vertically extending passageway therebetween for the passage of at least one wire.

* * * * *